US005672935A

United States Patent [19]

Ito et al.

[11] Patent Number: 5,672,935

[45] Date of Patent: Sep. 30, 1997

[54] SUPPORTING MEMBERS FOR A COLOR SELECTING ELECTRODE ASSEMBLY

[75] Inventors: Hideya Ito; Shoji Morimoto; Junko Itoh, all of Amagasaki; Akira Yamada, Nagasaki; Atsushi Hattori; Hiroyuki Sakaiya, both of Nagaokakyo, all of Japan

[73] Assignee: Mitsubishi Denki Kabushiki Kaisha, Tokyo, Japan

[21] Appl. No.: 551,668

[22] Filed: Nov. 1, 1995

[30] Foreign Application Priority Data

Dec. 12, 1994 [JP] Japan ..... 6-307932

[51] Int. Cl.[6] ..... H01J 29/07

[52] U.S. Cl. ..... 313/406; 313/404; 313/407

[58] Field of Search ..... 313/404, 406, 313/408, 402, 403, 407

[56] References Cited

U.S. PATENT DOCUMENTS 4,652,792 3/1987 Tokita et al. ..... 313/404
4,886,997 12/1989 Inoue et al. ..... 313/406
5,003,218 3/1991 Gijrath et al. ..... 313/406
5,416,377 5/1995 Kim ..... 313/406

FOREIGN PATENT DOCUMENTS 62-2432 1/1987 Japan ..... H01J 29/02

*Primary Examiner*—Michael Horabik
*Assistant Examiner*—Michael Day
*Attorney, Agent, or Firm*—Oblon, Spivak, McClelland, Maier & Neustadt, P.C.

[57] ABSTRACT

A color selecting electrode assembly for color cathode ray tubes includes: an aperture grill having thin slits; a frame over which the aperture grill is stretched; and supporting members in which a fixing portion at one end is attached to the frame and an engaging portion at the other end is engaged with a panel pin provided on a panel side wall so as to support the frame. An elastic portion of the supporting members is arranged in such a manner that boundary portions of the elastic portion with the fixing portion and the engaging portion become parallel to a longitudinal-direction of the slits. An engaging hole bored in the engaging portion is provided at such a position that the engaging hole intersects with an imaginary extension plane in which a joining portion of the frame and the aperture grill is extended in a direction parallel to a tube axis of a color cathode ray tube.

6 Claims, 11 Drawing Sheets

SUPPORTING MEMBERS FOR A COLOR SELECTING ELECTRODE ASSEMBLY

BACKGROUND OF THE INVENTION

The present invention relates to an aperture grill-type color selecting electrode assembly for color cathode ray tubes, and more particularly to a color selecting electrode assembly for color cathode ray tubes capable of reducing a landing color drift (temperature drift) associated with a change in temperature of a color cathode ray tube.

A general configuration of a conventional color selecting electrode assembly for color cathode ray tubes is shown in a perspective view of FIG. 6. Numeral 1 designates an aperture grill in which many thin grids forming slit 11 are arranged; 2, a frame composed of a pair of holding members 21 fixed at one end to the aperture grill 1, and of a pair of elastic members 22 for developing a predetermined stretching force on the aperture grill 1, which are arranged across the holding members 21 and fixed to the holding members 21; 3, a supporting member which is fixed at one end to the frame 2, and has an engaging hole 311 at the other end for engaging with a pin (not shown) buried in a panel which is a part of the glass bulb of a color cathode ray tube; 4, a high-expansion plate which is fixedly welded to the elastic members 22 of the frame 2, and forms a bimetal structure with the elastic members 22; 5, a damper wire which is arranged in a manner to contact the aperture grill 1, and serves to damp the vibration of the aperture grill 1; and 6, a damper spring for serving to add a predetermined tension to the damper wire 5. Now, the supporting member 3 is composed of a spring 31 for generating a spring action, and of a metallic plate 32 for connecting the spring 31 with the frame 2. The spring 31 comprises a parallel joined alloy consisting of a high expansion coefficient metal 312 and a low expansion coefficient metal 313 to offer a temperature correction mechanism.

A general method of giving a tension to the aperture grill 1 is the one in which a predetermined displacement is allowed to develop previously on the frame 2 by an external force, then the aperture grill 1 is welded to the frame 2, and then the external force previously having been given to the frame 2 is released, and utilizing a restoring force of the frame which tends to return to the original position, a tension is allowed to develop on the aperture grill.

When power is applied to a color cathode ray tube, an electron beam is launched from the electron gun towards the fluorescent screen. Nearly 80% of the electron beam hits the aperture grill 1 to become a thermal energy, thereby causing the temperature of the aperture grill 1 to be raised. For several minutes after power is applied, the temperature of only the aperture grill 1 is increased. The thermal expansion of the aperture grill 1 reduces the tension of the aperture grill 1, and the degree of reduction depends on a displacement of the frame 2 which is required to allow the tension to be developed in the aperture grill 1, so that if the displacement is sufficiently secured, a phenomenon that the tension of the aperture grill 1 becomes zero and the aperture grill 1 is freely deformed will not happen.

Further, the thermal energy developed in the aperture grill 1 is transmitted to the frame 2 with passage of time, thereby causing the temperature of the entire color selecting electrode assembly to be raised. As a result, in an initial state, as shown in an illustrative view of FIG. 7(*a*), the relationship in position between the slit 11 of the aperture grill 1 positioned on the track of an electron beam 9 and a fluorescent member 8 formed on a panel front portion 10 is changed to a relationship in which the slit 11 has been moved in the direction parallel to the panel front portion 10 due to the thermal expansion by the temperature rise of the color selecting electrode assembly, so that the electron beam 9 hits a point out of the fluorescent member 8 as shown in an illustrative view of FIG. 7(*b*), thereby causing a color purity as color cathode ray tube to be deteriorated. The broken line indicates the original position of the aperture grill 1 shown in FIG. 7(*a*). Heretofore, to solve such problem, by the action of a supporting member having a temperature correction function, the frame and the aperture grill 1 are allowed to be close to the front portion 10, as shown in an illustrative view of FIG. 7(*c*), so that even when the temperature is raised, the electron beam 9 passing through the slit 11 on the aperture grill 1 reaches the fluorescent member 8. The broken line indicates the position of the aperture grill 1 before temperature correction and after thermal expansion.

The above-mentioned supporting member 3 is generally engaged with the panel pin of a panel side wall (not shown), as shown in typical side views of FIGS. 8(*a*) and 8(*b*), and the spring 31 comprises a bimetal consisting of the high expansion coefficient metal 312 and the low expansion coefficient metal 313 which are adhered to each other so that the metal 312 is positioned on the panel front portion 10 side while the metal 313 on the electron gun side. FIG. 8(*a*) shows an initial state; and FIG. 8(*b*) shows a state in which the supporting member corrects a thermal deformation. The temperature rise developed by the hit of the electron beam, and an associated temperature rise of the frame 2 cause the temperature rise of the supporting member 3, with the result that the spring 31 is curved by the action of the bimetal, as shown in FIG. 8(*b*). The supporting member 3 is engaged with the panel pin mounted on the panel side wall, and the position of the panel pin in the panel is not changed, with the result that the frame 2 is moved toward the panel front portion 10.

As described above, when a color cathode ray tube is operated, only the temperature rise of the color selecting electrode assembly is developed, so that it is not necessary to seriously consider the deformation due to the temperature rise of the panel. Also, the thermal deformation is substantially linearly proportional to the rising temperature, so that when a correction to a certain temperature is performed, even if the operation condition is changed to cause the temperature rise to be changed, the correction to the changed temperature can be performed. Such a change from the operation start of a color cathode ray tube through the deformation occurrence due to temperature rise to a stable state is called a time-dependent change.

As a change by which the relationship in position between the fluorescent member 8 and the slit 11 on the aperture grill 1 is changed due to the temperature of a color cathode ray tube, there is a change in operating environment temperature, other than the above-mentioned time-dependent change. In this case, the temperature of the entire operating environment is changed, so that not only the temperature of the color selecting electrode assembly is changed, but also that of the panel is changed. The thermal expansion coefficient of the panel used in general color cathode ray tubes is substantially the same as that of the color selecting electrode assembly, so that even if the environment temperature is changed, the electron beam 9 having passed through the slit 11 on the aperture grill 1 will be at a position at which the beam reaches the fluorescent member 8 on the front portion 10, as shown in an illustrative view of FIG. 9(*a*), and thus a deterioration in color purity is less. The broken line indicates an initial state before temperature change. Such a change of the relationship in position between the fluorescent member 8 and the slit 11 developed by the change of environment temperature is called an environment temperature drift.

However, as described above, where a bimetal-type supporting member is used to correct the time-dependent change, the bimetal composing the spring 31 responds to a change in environment temperature to cause the temperature correction to function, with the result that, for example, if the environment temperature is changed to a high temperature side, the aperture grill 1 will be displaced toward the panel front portion 10 as shown in an illustrative view of FIG. 9(*b*), so that the slit 11 will be positioned at a place at which the electron beam 9 is hit out of the fluorescent member 8. The broken line indicates a state before the temperature correction mechanism functions. Thus, the correction of the time-dependent change deteriorates the characteristic of the environment temperature drift, so that in the current situation, considering both the characteristics of time-dependent change and environment temperature drift, a compromise between them has been made to some extent to adjust.

As a method of correcting satisfactorily both characteristics of time-dependent change and environment temperature drift, there has been proposed the employment of the supporting member having a structure as shown in Japanese Unexamined Patent Publication No. 2432/1987. The supporting member 3, as shown in a perspective view of FIG. 10, is composed of a fixing portion 33 for fixing to the frame 2, an engaging portion 35 for engaging with the panel pin, and an elastic portion 34 between the fixing portion 33 and the engaging portion 35, and arranged in such a manner that the fixing portion 33, the elastic portion 34 and engaging portion 35 are positioned substantially parallel to the tube axis.

The supporting member 3 having such a structure performs the correction not by a method such as bimetal method in which correction is made in response to temperature change, but by a method in which the supporting member responds to a dimensional change due to the thermal expansion of the panel pin and the frame in the plane perpendicular to the tube axis. Where the frame 2 is thermally expanded due to the time-dependent change, the elastic portion 34 is deformed to cause the frame 2 to be pushed forward, as shown in an illustrative view of FIG. 11, thereby performing a necessary correction. However, for the environment temperature drift, as shown in an illustrative view of FIG. 12, the panel is also thermally expanded as with the frame 2, and thus no deforming force is applied to the elastic portion 34, so that the frame 2 cannot be pushed forward, and thus an unnecessary correction is not performed. In FIGS. 11 and 12, the broken line indicates a position in an initial state.

The means of responding to such a dimensional change to correct is generally called a longitudinal spring, considering its shape, which is widely used for a shadow mask method in which a press-molded metallic sheet having an round hole or slot is fixed to the frame. In the case of the shadow mask method, the dimensional change of the frame due to temperature change is substantially only by free expansion, and the shape is changed similarly, so that the correction can be performed.

On the contrary, in the case of the means of applying a tension such as the aperture grill, if a difference in thermal expansion between the aperture grill and the frame develops due to temperature change, a change in tension other than free expansion acts on the frame as shown in FIG. 13(*b*), so that the shape does not become the one similar to the original. FIGS. 13(*a*) and 13(*b*) are illustrative views showing a non-similar deformation state developed in the aperture grill-type color selecting electrode assembly, in which FIG. 13(*a*) shows an original state; and the broken line of FIG. 13(*b*) shows a state in which free expansion occurs, while the one-dot chain line shows a state in which free expansion and a change in tension act. Further, as shown in FIG. 6, the high-expansion plate 4 is attached to the elastic member 22 of the frame 2 to form a bimetal structure. This is to reduce a stress in the aperture grill by a bimetal effect during the thermal process in a process of manufacturing color cathode ray tubes, thereby preventing the aperture grill from being yield and extended. However, the bimetal action naturally responds to the temperature rise when a color cathode ray tube is operated, thereby leading to a deformed frame. Thus, in the case of the aperture grill, the frame deformation due to temperature change exhibits a complex movement, so that it has been difficult to correct satisfactorily the dislocation of the electron beam from the fluorescent member due to thermal deformation even if a supporting member having a longitudinal spring structure is used.

As described above, the conventional aperture grill-type structure of color selecting electrode assembly for color cathode ray tubes cannot perform the correction in a manner to sufficiently satisfy both characteristics of time-dependent change and environment temperature drift, so that there has been a problem that a portion to be corrected remains. Thus, there is deteriorated the color purity by a dislocation of the electron beam from the fluorescent member due to thermal deformation (temperature drift), particularly in a large-size, high-definition color cathode ray tube.

The present invention is made to solve the above-mentioned problems, and it is an object of the invention to provide an aperture grill-type color selecting electrode assembly in which a supporting member of a longitudinal spring structure is used to correct effectively dislocation of an electron beam from a fluorescent member due to thermal deformation, thereby obtaining a color cathode ray tube exhibiting no color drift.

SUMMARY OF THE INVENTION

A color selecting electrode assembly for color cathode ray tubes comprises an aperture grill having thin slits, a frame over which the aperture grill is stretched, and supporting members in which a fixing portion at one end is attached to the frame and an engaging portion at the other end is engaged with a panel pin provided on a panel side wall so as to support the frame, wherein an elastic portion of the supporting members is arranged in such a manner that boundary portions of the elastic portion with the fixing portion and the engaging portion, which are at both ends of the elastic portion, become parallel to a longitudinal direction of the slits, and an engaging hole bored in the engaging portion for engaging with the panel pin is provided at such a position that the engaging hole intersects with an imaginary extension plane in which a joining portion of the frame and the aperture grill is extended in a direction parallel to a tube axis of a color cathode ray tube.

A color selecting electrode assembly for color cathode ray tubes has a structure in which one of supporting members arranged in a direction longitudinal to the slits of the aperture grill is engaged with the panel pin in a manner to be movable in the longitudinal direction to the panel.

A color selecting electrode assembly for color cathode ray tubes has a structure in which a sub-supporting member is disposed in such a manner that one end of the sub-supporting member is attached to a central part of a pair of frame sides of the frame over which the aperture grill is stretched and the other end of the sub-supporting member is engaged with a panel pin provided on a panel side wall opposite to the frame side.

A color selecting electrode assembly for color cathode ray tubes has a structure in which a sub-supporting structure body is engaged with the panel pin in a manner to be movable in a tube axis direction to the panel.

In the color selecting electrode assembly for color cathode ray tubes the supporting member has a longitudinal spring structure which is composed of the fixing portion, elastic potion and engaging portion to perform a thermal deformation correction in response to the difference in thermal expansion between the frame and the panel, and the elastic potion is mounted in a manner to be parallel to the longitudinal direction of the slit of the aperture grill (that is, the boundary portions of the elastic portion with the fixing portion and the engaging portion corresponding to both ends of the elastic portion are parallel to the longitudinal direction of the slit), so that the elastic potion performs the correction only for the difference in thermal expansion between the frame and the panel in the arrangement direction perpendicular to the longitudinal direction of the slit of the aperture grill. Therefore, even if a deformation develops in the longitudinal direction of the slit of the aperture grill which is not required to correct, an unnecessary correction will not be preformed. Also, the engaging hole for engaging with the panel pin which hole is provided in the engaging portion is arranged in a manner to intersect with an imaginary extension plane in which a joining portion of the aperture grill with the frame is extended in the direction parallel to the tube axis, so that even if the supporting member is rotated about the engaging hole due to frame deformation, an occurrence of unnecessary deformation can be restricted. A correction can be performed which can satisfy both characteristics of time-dependent change and environment temperature drift.

In the color selecting electrode assembly for color cathode ray tubes, one of the supporting members which are arranged in the longitudinal direction of the slit of the aperture grill, together with the supporting member opposite thereto, are not restricted for the movement thereof in the longitudinal direction of the slit of the aperture grill by the panel pin. That is, they are movable in the longitudinal direction, so that even where the panel pin is arranged on the same side of the panel, an unnecessary force does not act on the supporting member due to a difference in thermal expansion between the frame and the panel, and thus an unnecessary deformation does not develop.

In the color selecting electrode assembly for color cathode ray tubes, the sub-supporting member is additionally arranged on the central part of a pair of frame sides to which the aperture grill is joined, so that even if a shock or a vibration is applied to a color cathode ray tube, the supporting member will not fall from the panel pin.

In the color selecting electrode assembly for color cathode ray tubes, the sub-supporting member is not restricted for the movement thereof in the tube axis direction, so that an unnecessary force does not act on the other supporting member performing the correction of thermal expansion.

DETAILED DESCRIPTION

Example 1

Figure 1:
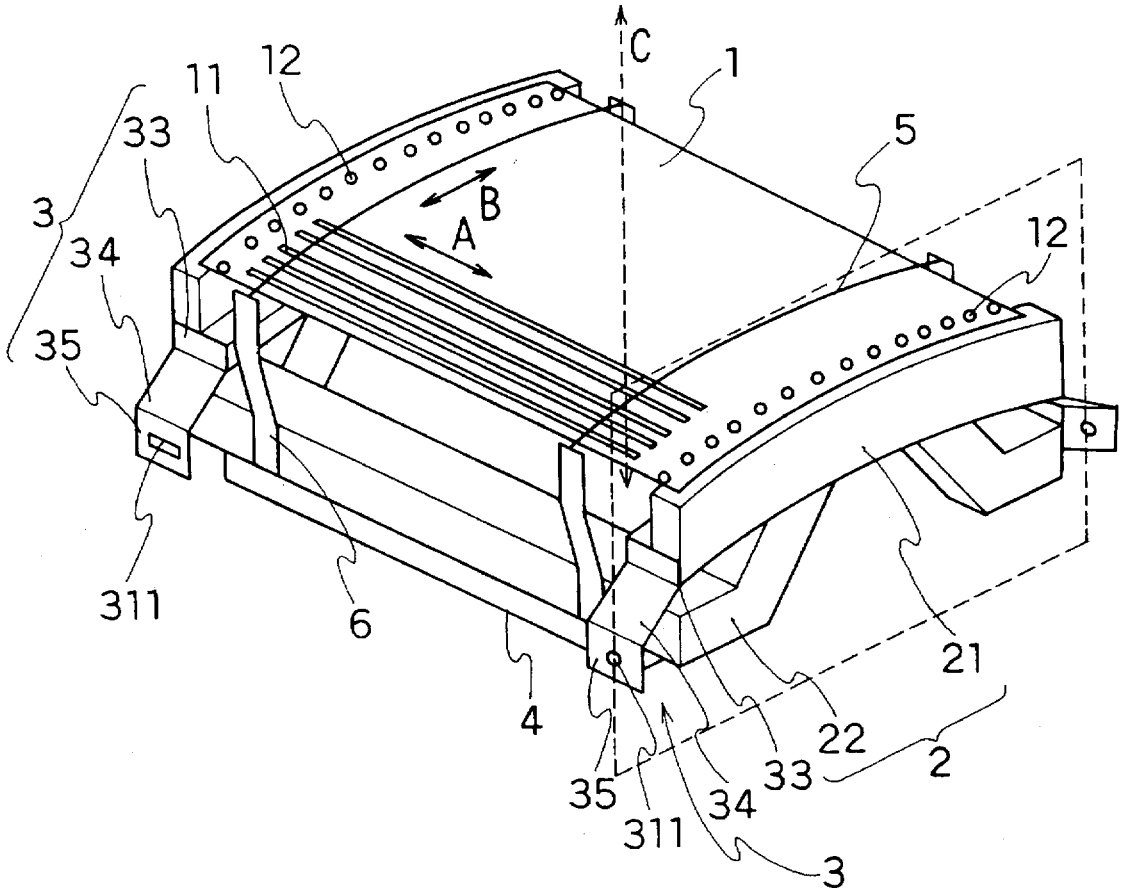
FIG. 1 is a perspective view showing a color selecting electrode assembly for color cathode ray tubes of Example 1 of the present invention.

With reference to the perspective view of FIG. 1, the color selecting electrode assembly for color cathode ray tubes of Example 1 of the present invention will be explained hereinafter. The aperture grill 1 having slits 11 is fixed to the end faces of holding members 21 of a frame 2 composed of a pair of holding members 21 and a pair of elastic members 22. The supporting member 3 comprises a fixing portion 33 for fixing to the frame 2, an engaging portion 35 for engaging with the panel pin, and an elastic-portion 34 between the fixing portion 33 and the engaging portion 35. The fixing portion 33 is fixedly welded to both ends of the holding members 21 of the frame 2, and the elastic portion 34 is arranged in a manner to be parallel to the longitudinal direction of the slit 11 of the aperture grill 1 (that is, the boundary portions of the elastic portion 34 with the fixing portion 33 and engaging portion 35, both of which correspond to both ends of the elastic portion 34, are parallel to the longitudinal direction of the slit 11). Also, an engaging hole 311 of the engaging portion 35 is provided in a manner to intersect with an imaginary plane in which the extension line of a joining line 12 of the aperture grill 1 with the frame 2 is extended in he direction parallel to the tube axis. Further, one of the two supporting members 3 which are arranged in the longitudinal direction of the slit 11 of the aperture grill 1, together with the supporting member opposite thereto, have an engaging hole 311 engaging with the panel pin which has a longer side in the longitudinal direction of the slit 11 and thus is rectangular in shape, and have a movable structure such that the engaging portion 35 is not restricted for the movement thereof in the longitudinal direction of the aperture grill 1 by the panel pin. A high-expansion plate 4 is mounted on the bottom of the elastic member 22 of the frame 2, and a damper wire 5 and a damper spring 6 are mounted to damp a vibration of the aperture grill 1. Arrow A indicates a longitudinal direction of the slit 11 of the aperture grill 1; arrow B, an extension direction of the slit 11 of the aperture grill 1; and arrow C, a tube axis direction.

The aperture grill 1 is fixedly welded to the holding member 21 of the frame 2, so that a deformation due to thermal expansion of the slit 11 of the aperture grill 1 depends on a deformation of the holding member 21. Further, the fluorescent screen has a stripe shape corresponding to the slit 11, so that even if a deformation with respect to the longitudinal direction of the slit 11, among deformations of slit 11 of the aperture grill 1, develops, no color drift develops and thus the correction is not required. Among the deformations of slit 11, the one requiring the correction is a deformation in the disposition direction of the slit 11, and a deformation of the slit 11 depends on the holding member 21 of the frame 2, so that it is sufficient to correct the deformation in the arrangement direction of the slit 11 of the holding member 21. The supporting member 3 in the present invention is fixed to the end of the holding member 21, and the correction function acts in response to a change in the distance between the holding member 21 and the panel placed in the extension line thereof. The elastic member 34 of the supporting member 3 is mounted parallel to the longitudinal direction of the slit 11 of the aperture grill, so that the elastic member 34 performs the correction only for the difference in thermal expansion between the frame and the panel in the arrangement direction perpendicular to the longitudinal direction of the slit of the aperture grill 1. Therefore, even if a deformation in the longitudinal direction of the slit 11 of the aperture grill 1 which is not required to correct develops, an unnecessary correction will not be performed.

Figure 2A:
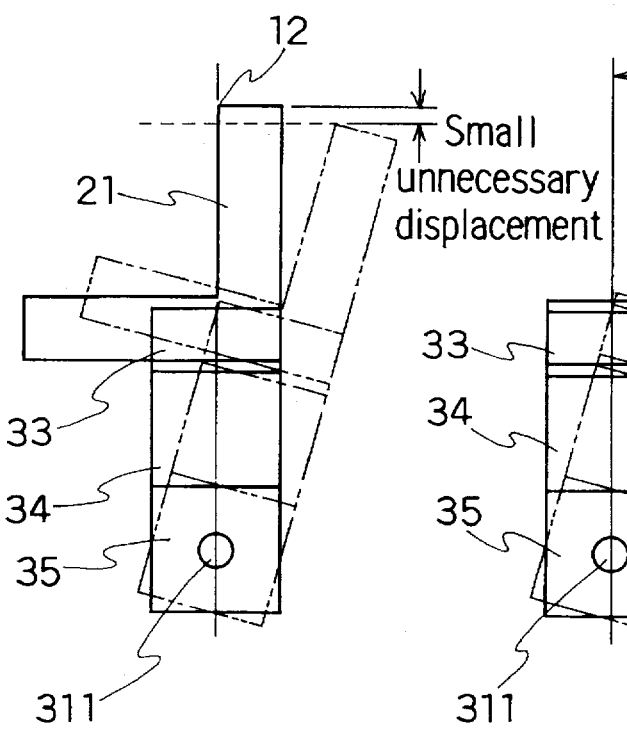
FIG. 2 is an illustrative view explaining the action and effect by the arrangement of an engaging hole of a supporting member in connection with the present invention.
Figure 2B:
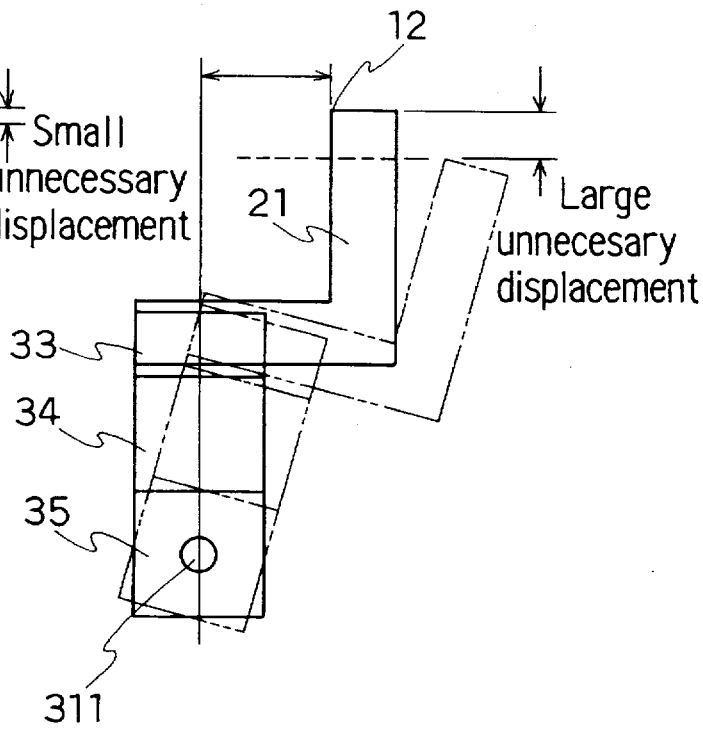

Further, when viewed from the arrangement direction of the slit 11, as shown in the illustrative view of FIG. 2(*a*), the engaging hole 311 is positioned in a manner to intersect with an imaginary plane in which the joining portion 12 of the aperture grill 1 with the frame 2 is extended in the direction parallel to the tube axis, so that if a non-similar deformation develops in the frame, an unnecessary displacement developed due to the rotation of the supporting member about the engaging hole can be made less than that developed where the engaging hole 311 is out of the imaginary plane in which the joining portion 12 of the aperture grill 1 with the frame 2 is extended in the direction parallel to the tube axis as shown in the illustrative view of FIG. 2(*b*), and thus provides no problem. In FIG. 2, the solid line indicates a state before deformation, while the two-dot chain line indicates a state after deformation. Even where the bimetal effect formed by the frame 2 and the high-expansion plate 4 mounted on the frame 2 is made large to reduce a yield of the aperture grill 1 during the thermal process, no problem with the characteristics of time-dependent change and environment temperature drift develops as described above, so that the bimetal effect can be made large to reduce a yield of the aperture grill 1 during the thermal process.

The correction can be performed in a manner to satisfy sufficiently both the characteristics of time-dependent change and environment temperature drift, and even where a color cathode ray tube is made a large size and a high definition, a deterioration in the color purity due to the drift of the electron beam from the fluorescent member by thermal expansion can be prevented.

A color selecting electrode assembly having the above-mentioned structure was applied to a 21-inch display monitor to study, with the result that no matter how hard we adjust a color selecting electrode assembly having a conventional structure by considering both the characteristics of time-dependent change and environment temperature drift, the electron beam movement developed by about 15 μm, while when the structure of this Example was used, both the characteristics could be put within 5 without compromisingly adjusting the both. Further, for the conventional structure, the thermal deformation developed by the bimetal action of the elastic member 22 of the frame 2 and the high-expansion plate 4 affects the characteristics of time-dependent change and environment temperature drift, so that a sufficient bimetal effect required to prevent the tension reduction due to the yield of the aperture grill 1 during the thermal process could not be exhibited. On the contrary, for the structure of the present invention, the thermal deformation developed by the bimetal action of the elastic member 22 of the frame 2 and the high-expansion plate 4 does not affect the characteristics of time-dependent change and environment temperature drift, so that a sufficient bimetal effect could be exhibited. Thus, the tension reduction during the thermal process was about 30% for the conventional structure, while the reduction could be put in about 10% for that of this Example, so that not only the reduction in the color purity due to temperature change could be improved, but also a color cathode ray tube having excellent vibration characteristics could be obtained.

Even where a color cathode ray tube is made a large size and a high definition, a high-performance color cathode ray tube could be obtained.

Example 2

Figure 3:
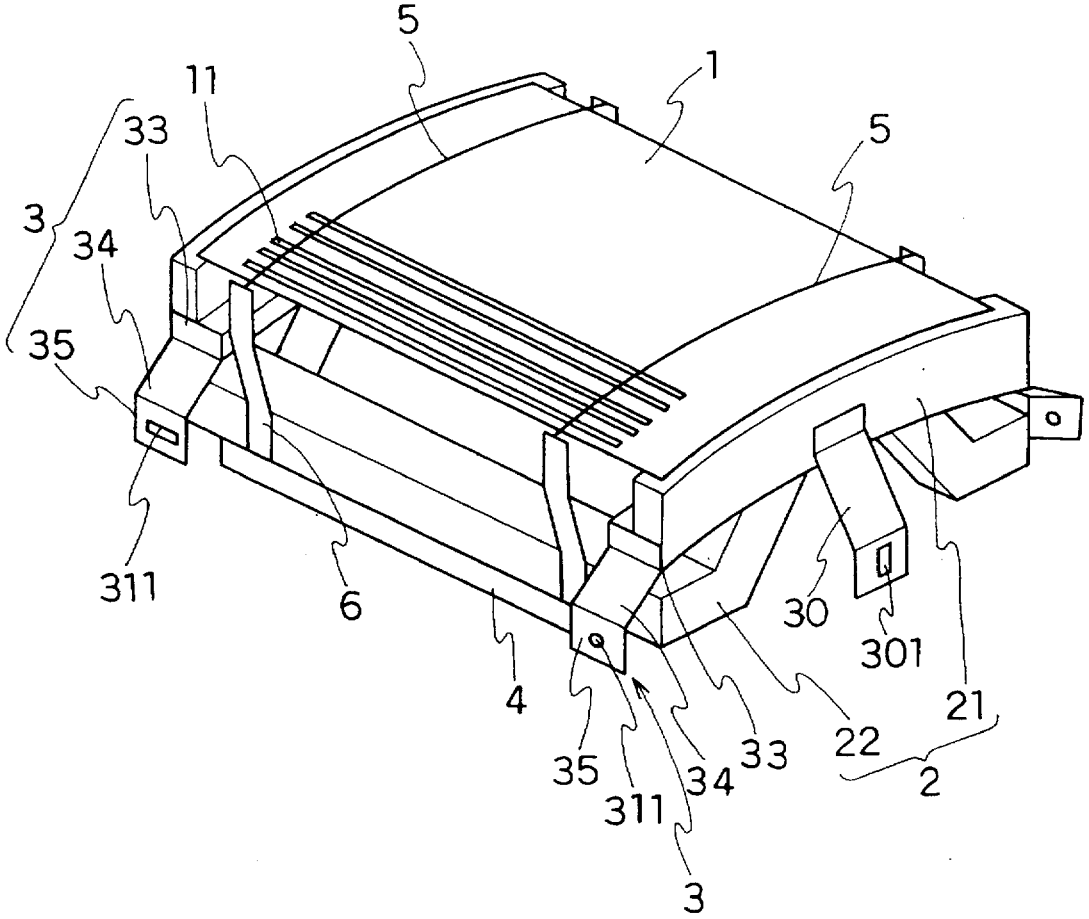
FIG. 3 is a perspective view showing a color selecting electrode assembly for color cathode ray tubes of Example 2 of the present invention.

FIG. 3 is a perspective view showing the structure of a color selecting electrode assembly for color cathode ray tubes of Example 2 of the present invention. A sub-supporting member 30 is disposed on the central part of the holding members 21 which are the frame sides, over which the aperture grill 1 is stretched, of the frame 2 of the color selecting electrode assembly for color cathode ray tubes of Example 1 shown in FIG. 1, whereby the structure is supported by six points. The structure of the above-mentioned Example 1 is supported only four spring forces with respect to the disposition direction of the slit 11, so that if a shock force due to falling and the like is applied in the disposition direction of the slit 11, the structure will be apt to come off. On the contrary, in this Example 2, the sub-supporting member 30 for restricting a movement in the disposition direction of the hole is mounted on the central part of the holding member 21, so that even if a shock or vibration due to falling and the like is applied to a cathode ray tube, the supporting member body will not be fallen from the panel pin.

Also, the sub-supporting member 30 at the central part of the holding member 21 is not required to restrict with respect to the tube axis and the longitudinal direction of the slit 11, and on the contrary, if it is restricted, the correction of the other four supporting structure bodies will be inhibited. Therefore, an engaging hole 301 is made a rectangular shape which has the longer side in the tube axis direction, whereby a movement in the tube axis direction is not restricted, while with respect to the longitudinal direction of the slit, the spring pressure is made weak, whereby the correction of the other four supporting members is not inhibited. Thus, the correction can be smoothly performed.

Figure 4:
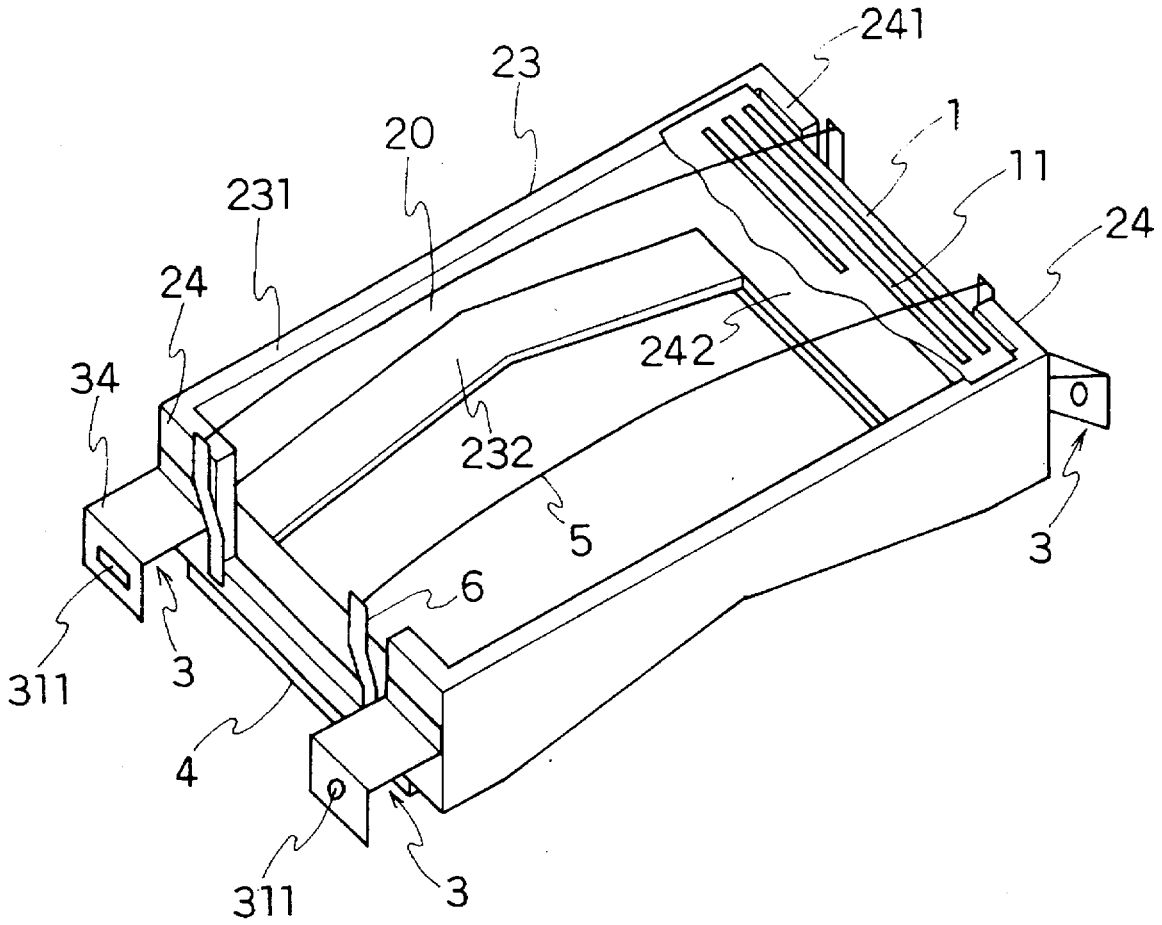
FIG. 4 is a perspective view showing a color selecting electrode assembly for color cathode ray tubes of a modification example of Example 1 of the present invention.

FIG. 4 is a perspective view showing a color selecting electrode assembly for color cathode ray tubes in which the supporting member 3 of the above-mentioned Example is applied to an integrally molded frame 20. The frame 20 is formed by pressing a sheet of plate, and has a rectangular shape consisting of two pairs of two opposite sides. One pair of sides are aperture grill welded sides 23 to which the aperture grill 1 is welded, while the other pair of sides are aperture grill non-welded sides 24 connecting the aperture grill welded sides 23. The cross-sectional shape of both the pairs is an L-shape composed of skirt portions 231, 241 and flange portions 232, 242. The supporting member 3 is fixedly welded to both ends of the skirt portion 241 of the aperture grill non-welded sides 24, and the elastic portion 34 of the supporting member 3 is arranged parallel to the longitudinal direction of the slit 11, whereby the same effect as the above-mentioned Example is exhibited.

Figure 5:
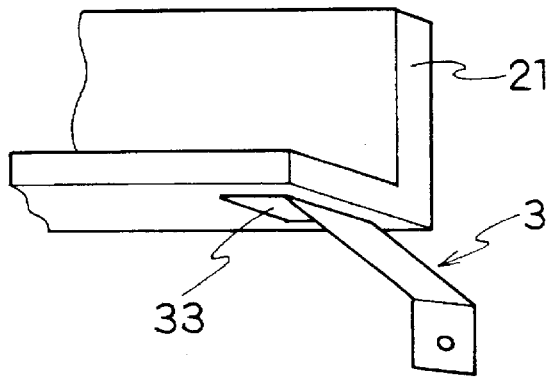
FIG. 5 is a perspective view showing an example of attachment of the supporting member in connection with the present invention.
Figure 6:
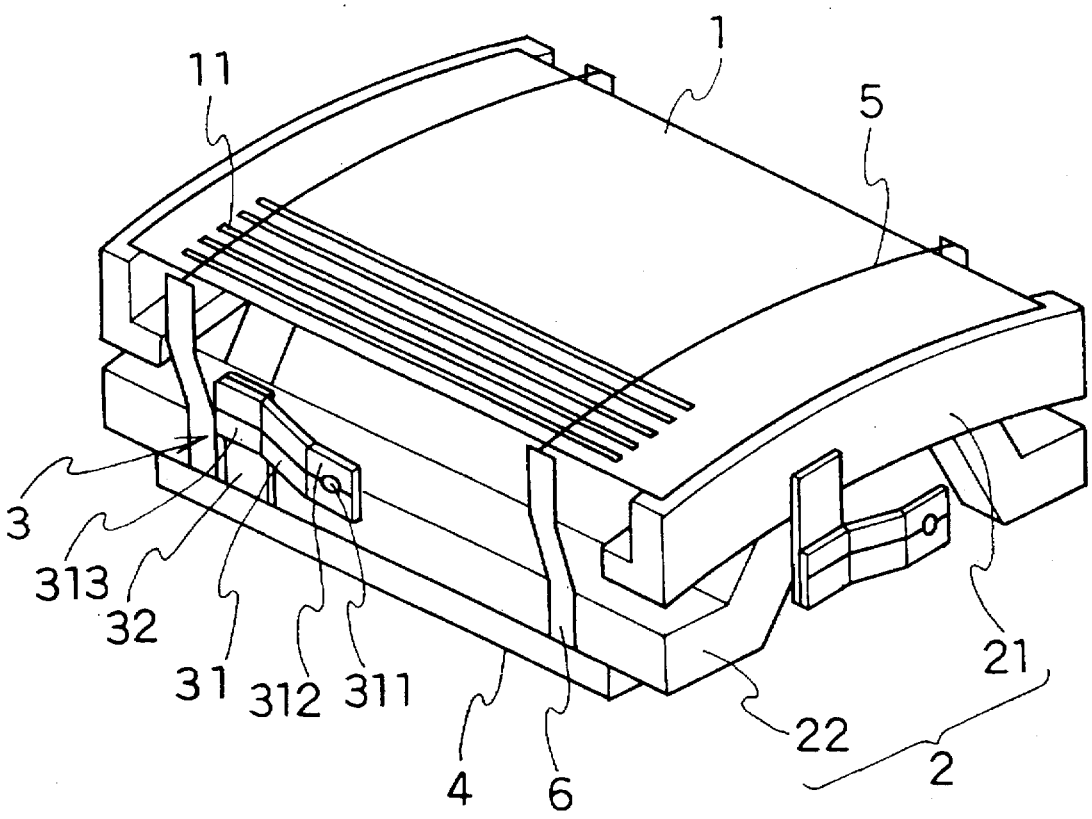
FIG. 6 PRIOR ART
FIG. 6 is a perspective view showing a conventional color selecting electrode assembly for color cathode ray tubes.
Figure 7A:
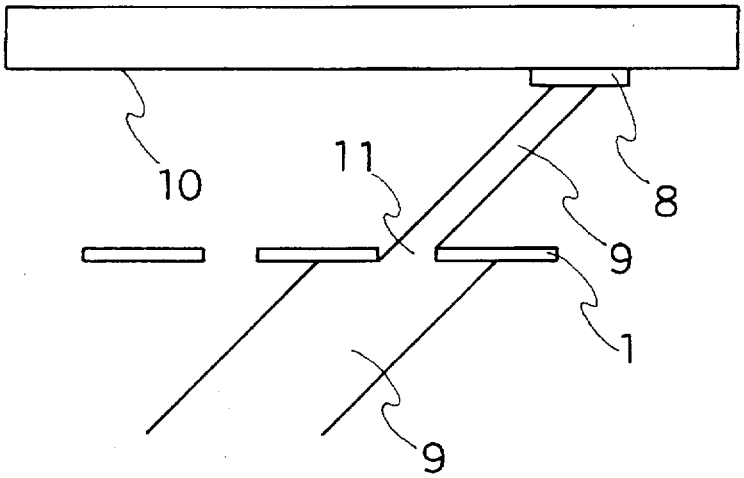
FIG. 7(a) PRIOR ART
FIG. 7 is an illustrative view showing the relationship in position among the slit, fluorescent member and electron beam in the initial operating state and in the operating state (before and after correction) of a color cathode ray tube using the conventional color selecting electrode assembly for color cathode ray tubes.
Figure 7B:
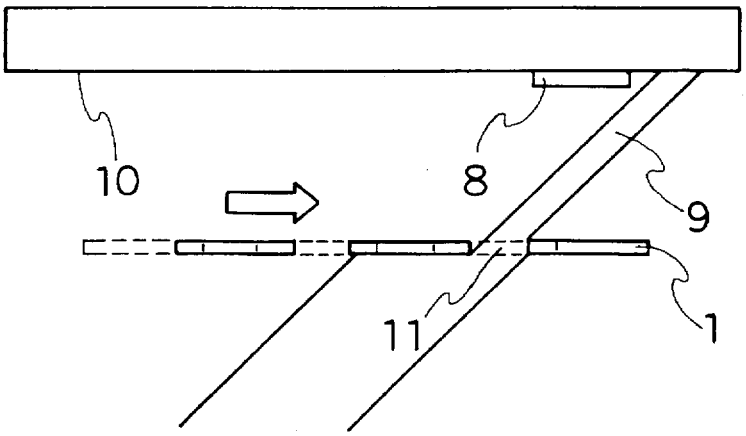
FIG. 7(b) PRIOR ART
Figure 7C:
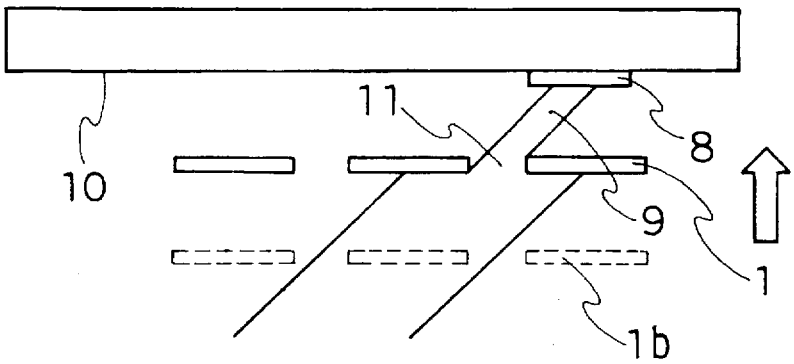
FIG. 7(c) PRIOR ART
Figure 8A:
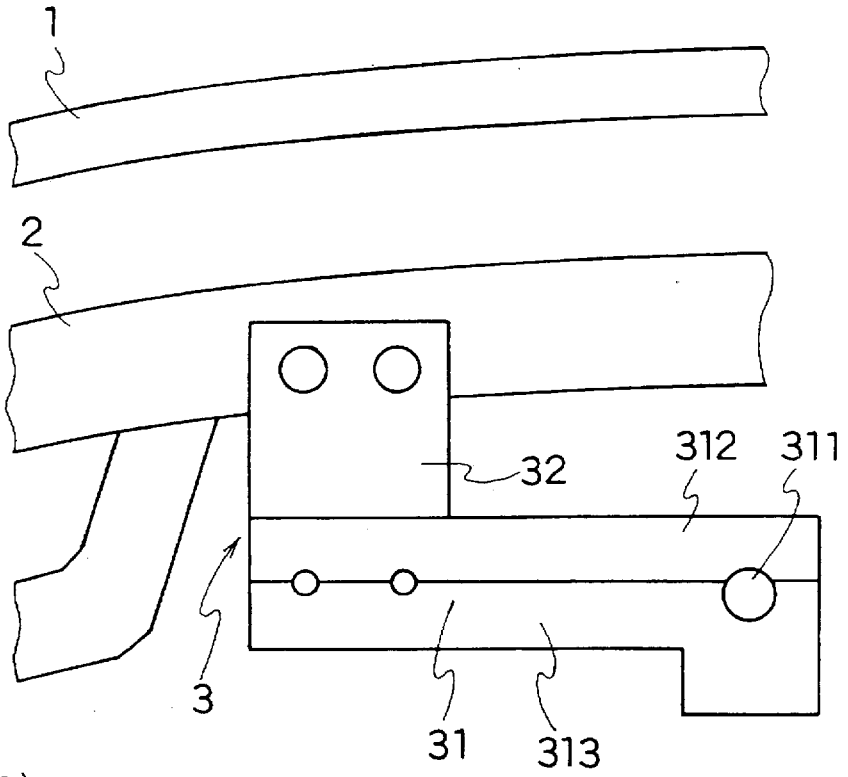
FIG. 8(a) PRIOR ART
FIG. 8 is a side view showing a structure of the supporting member of the conventional color selecting electrode assembly for color cathode ray tubes, and a state in which thermal deformation is corrected.
Figure 8B:
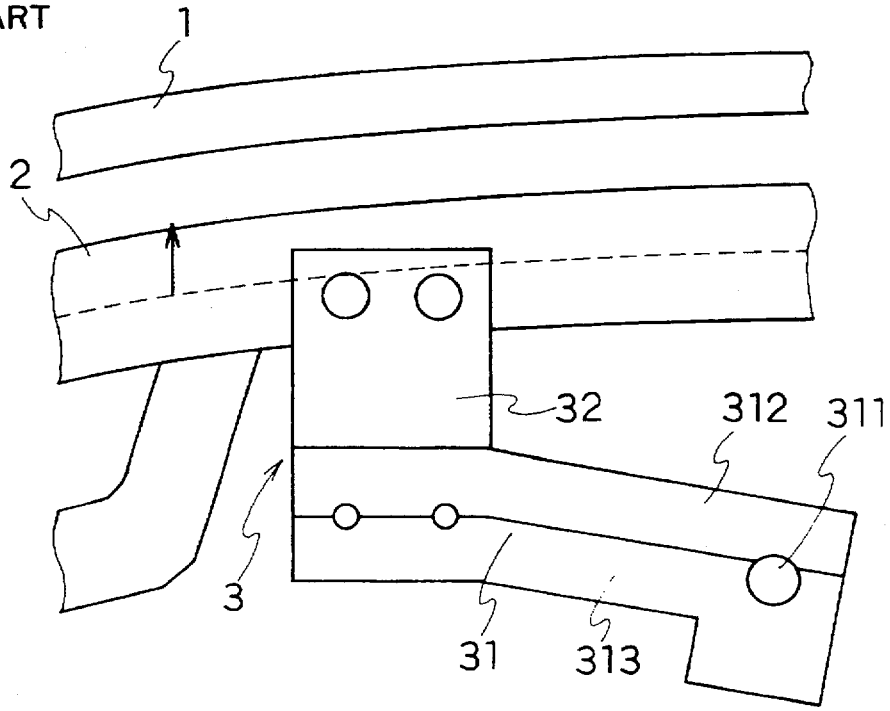
FIG. 8(b) PRIOR ART
Figure 9A:
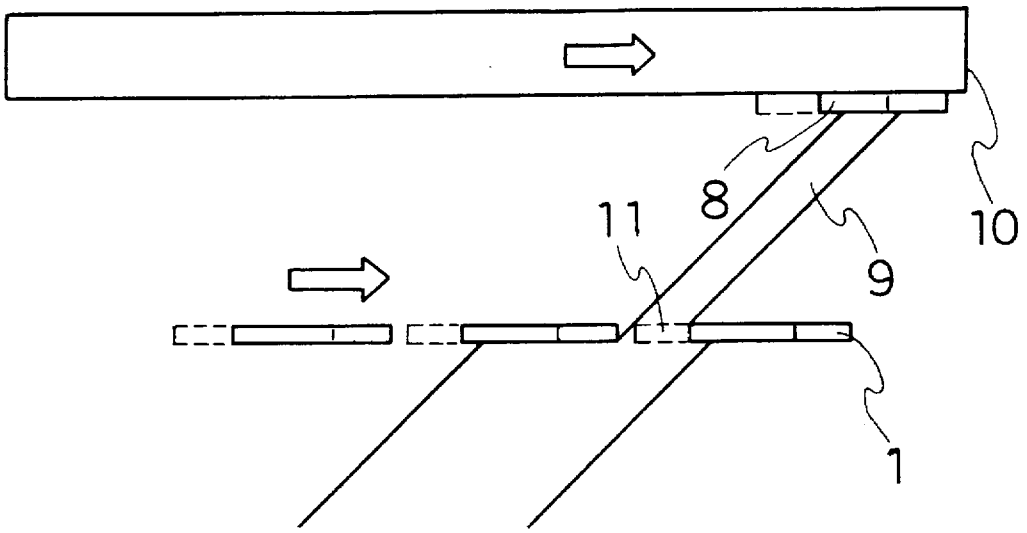
FIG. 9(a) PRIOR ART
FIG. 9 is an illustrative view showing the relationship in position among the slit, fluorescent member and electron beam where the supporting member has a correction mechanism and where it has no correction mechanism, when the operating environment temperatures of a color cathode ray tube using the conventional color selecting electrode assembly for color cathode ray tubes is changed.
Figure 9B:
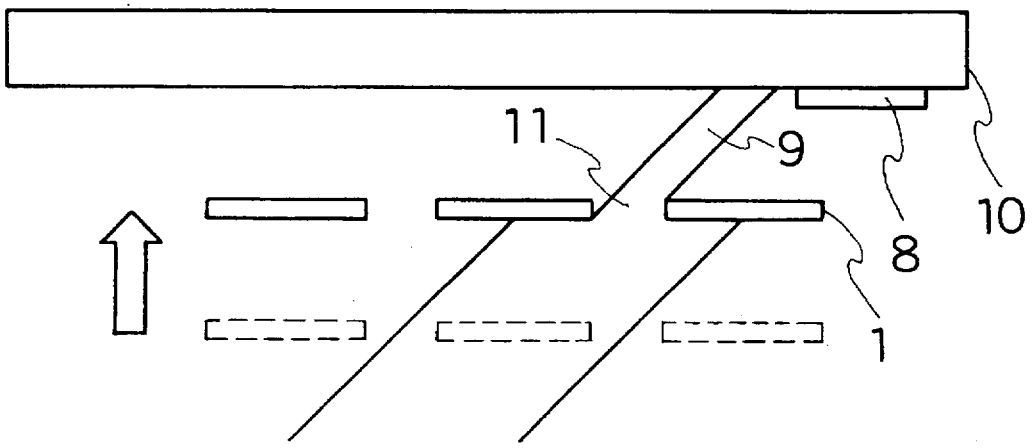
FIG. 9(b) PRIOR ART
Figure 10:
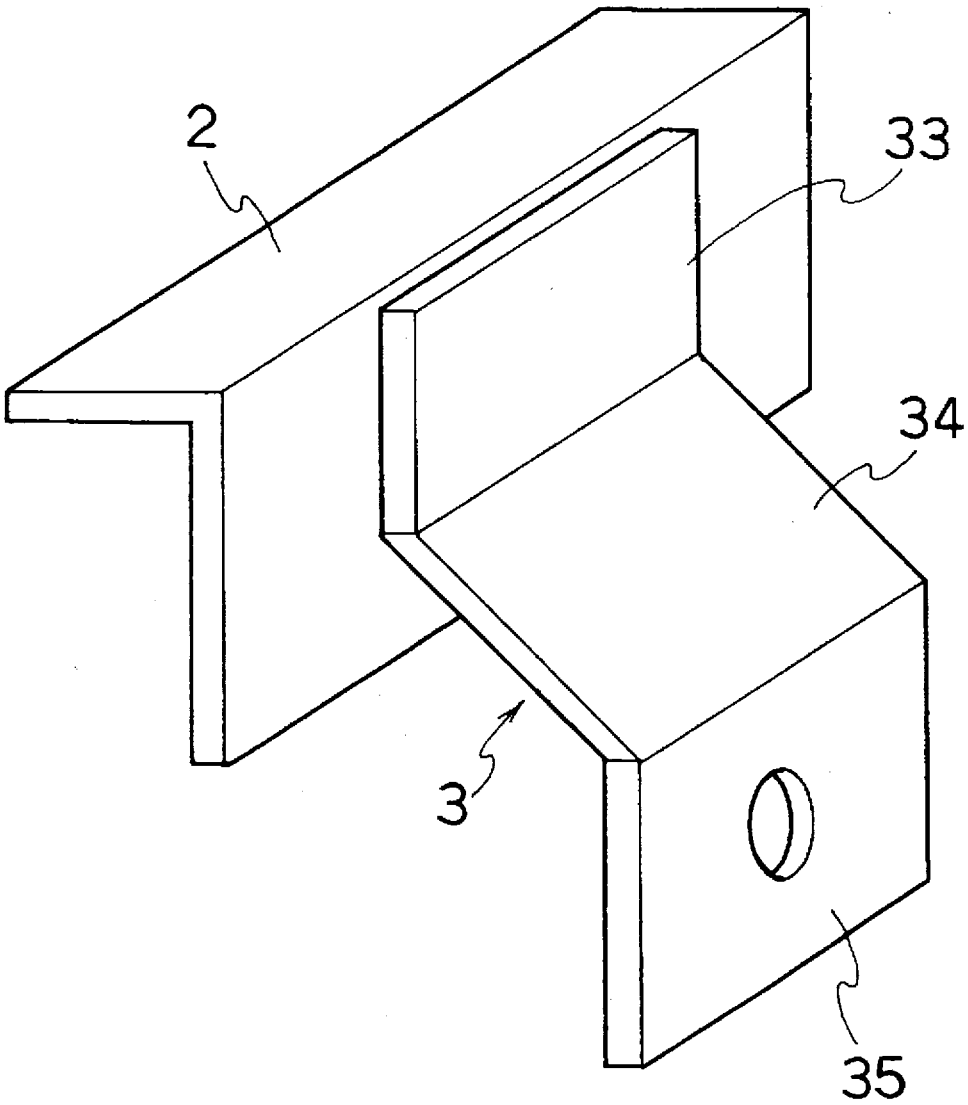
FIG. 10 PRIOR ART
FIG. 10 is a perspective view showing a longitudinal spring-type supporting member used in a conventional shadow mask-type color selecting electrode assembly body for color cathode ray tubes.
Figure 11:
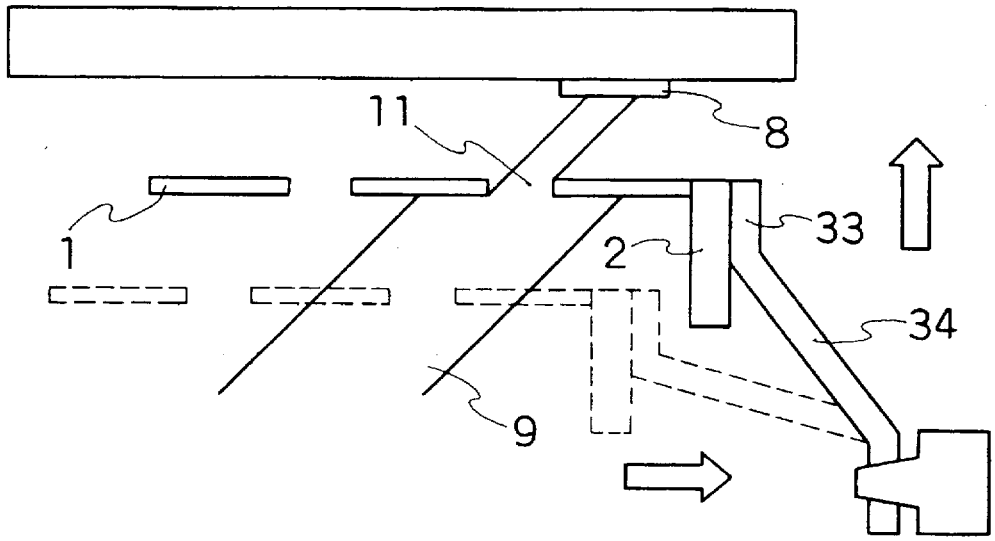
FIG. 11 PRIOR ART
FIG. 11 is an illustrative view showing the relationship in position among the slit, fluorescent member and electron beam of a color cathode ray tube using a color selecting electrode assembly for color cathode ray tubes including the longitudinal spring-type supporting member of FIG. 10, in the operating state.
Figure 12:
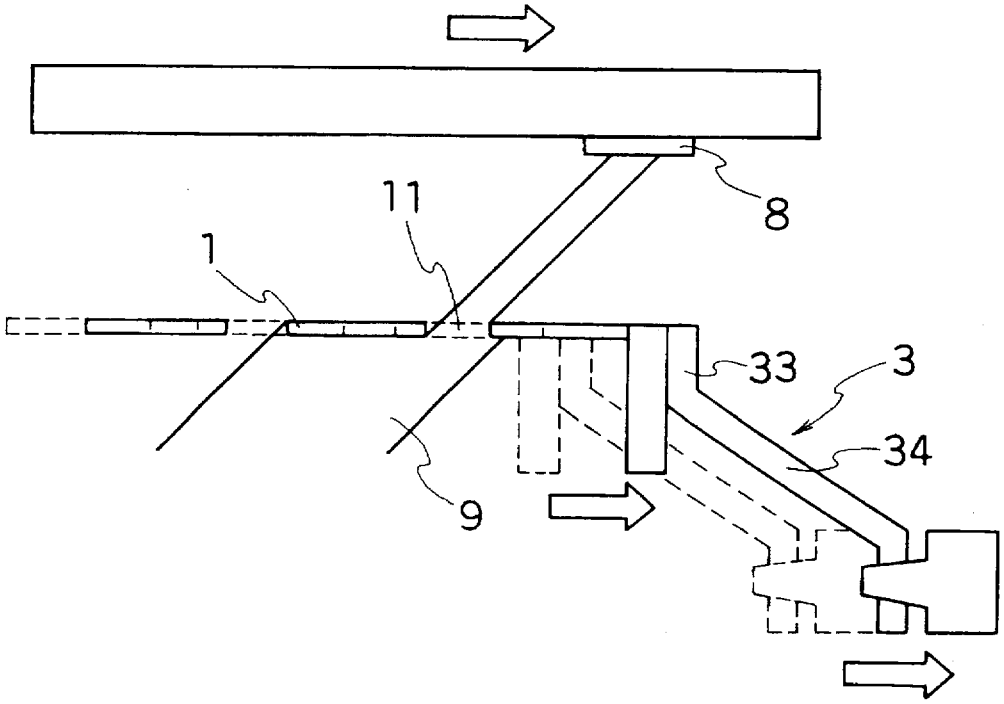
FIG. 12 PRIOR ART
FIG. 12 is an illustrative view showing the relationship in position among the slit, fluorescent member and electron beam of a color cathode ray tube using a color selecting electrode assembly for color cathode ray tubes including the longitudinal spring-type supporting member of FIG. 10, when an operating environment temperature is changed.
Figure 13A:
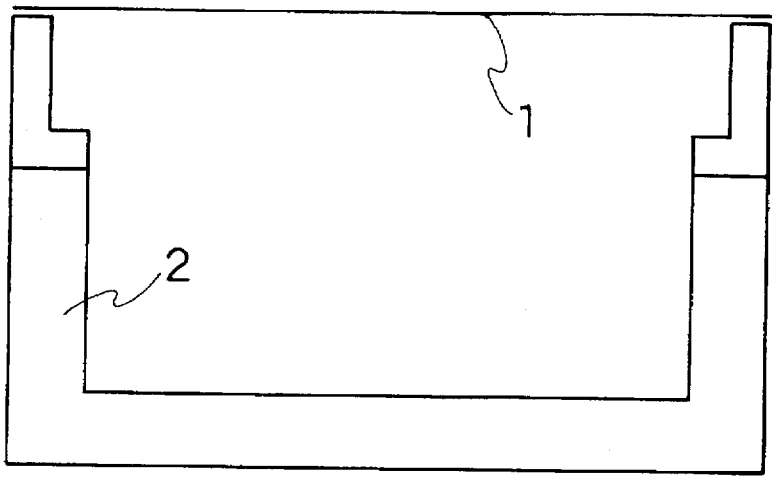
FIG. 13(a) PRIOR ART
FIG. 13 is an illustrative view showing a non-similar deformation state developed in an aperture grill-type color selecting electrode assembly for color cathode ray tubes.
Figure 13B:
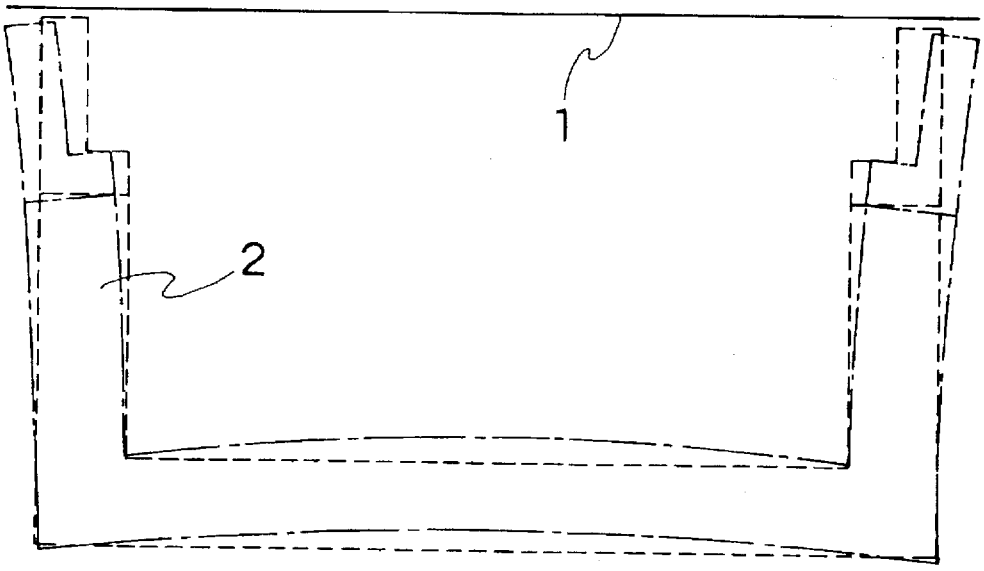
FIG. 13(b) PRIOR ART

Although the above-mentioned Example shows a structure in which the fixing portion 33 of the supporting member 3 is mounted on the end face (side face) of the holding member 21, the fixing portion 33 might be fixed to the bottom as shown in the perspective view of the supporting member 3 of FIG. 5. Where the supporting member 3 is fixed to the end face of the holding member 21 as shown in FIG. 1, the distance between the end face of the holding member 21 and the panel side wall must be made wide to secure the dimensions of the supporting member 3, whereby an effective screen to which a fluorescent material is applied becomes narrow. On the contrary, where a structure as shown in FIG. 5 is employed, the elastic portion 34 can be brought to the inside of the end face of the frame 2, whereby the above-mentioned effective screen can be made wider.

Although the above-mentioned Example shows a structure in which the fixing portion is mounted directly on the frame, the fixing portion might be mounted through parts on the frame.

As described above, in the color selecting electrode assembly for color cathode ray tubes in connection with the present invention, the supporting member holding the frame over which the aperture grill is stretched is made a structure composed of the fixing portion, the elastic portion and the engaging portion; the elastic portion is arranged parallel to the longitudinal direction of the slit of the aperture grill; and the engaging hole bored in the fitting portion for fitting to the panel pin is provided at a such position that the engaging hole intersects with an imaginary extension plane in which the joining portion of the frame and the aperture grill is extended in the direction parallel to the tube axis of a color cathode ray tube. Therefore, if a thermal deformation due to the temperature change of a color cathode ray tube develops, the elastic portion of the supporting member responds to only the dimensional change of the panel and the frame required for correction, thereby allowing the correction to be performed without compromisingly adjusting the characteristics of time-dependent change and environment temperature drift.

Further, even where the bimetal effect formed by the frame and the high-expansion plate mounted on the frame is made large to reduce a yield of the aperture grill during the thermal process, no problem with the characteristics of time-dependent change and environment temperature drift develops, so that the bimetal effect can be made large to reduce a yield of the aperture grill during the thermal process. Therefore, a color cathode ray tube having excellent vibration characteristics and without color drift can be obtained.

In the color selecting electrode assembly for color cathode ray tubes in connection with the present invention, one of the supporting members arranged in the longitudinal direction of the slit of the aperture grill has a structure in which the one is movable in the longitudinal direction and the dislocation is not restricted, so that even if a difference in the thermal expansion in the longitudinal direction of the slit between the panel and the frame develops, an unnecessary force does not act on the supporting members and an unnecessary deformation does not develop. Therefore, a better correction can be performed.

In the color selecting electrode assembly for color cathode ray tubes in connection with the present invention, the sub-supporting assembly is disposed on the central part of a pair of frame sides to which the aperture grill of the frame is joined, so that even if a shock load due to falling and the like is applied, the color selecting electrode assembly will not fall from the panel. Thus, the reliability is improved.

In the color selecting electrode assembly for color cathode ray tubes in connection with the present invention, the sub-supporting assembly is movable in the tube axis direction to the panel and not restricted for the movement thereof in the tube axis direction, so that an unnecessary force does not act on the other supporting members performing the correction of thermal expansion, thereby allowing a smooth correction.

Though several embodiments of the present invention are described above, it is to be understood that the present invention is not limited only to the above-mentioned and various changes and modifications might be made in the invention without departing from the spirint and scope thereof.

What is claimed is:

1. A color selecting electrode assembly for color cathode ray tubes comprising: an aperture grill having thin slits; a frame over which the aperture grill is stretched; and supporting members in which a fixing portion at one end is attached to the frame and an engaging portion at the other end is engaged with a panel pin provided on a panel side wall so as to support the frame, wherein an elastic portion of the supporting members is arranged in such a manner that boundary portions of the elastic portion with the fixing portion and the engaging portion, which are at both ends of the elastic portion, become parallel to a longitudinal direction of the slits, and an engaging hole bored in the engaging portion for engaging with the panel pin is provided at such a position that the engaging hole intersects with an imaginary extension plane containing a line of a joining portion of the frame and the aperture grill and extended in a direction parallel to a tube axis of a color cathode ray tube.

2. A color selecting electrode assembly for color cathode ray tubes of claim 1, wherein one of supporting members arranged in a direction longitudinal to the slits of the aperture grill is engaged with the panel pin in a manner to be movable in the longitudinal direction to the panel.

3. A color selecting electrode assembly for color cathode ray tubes of claim 2, wherein a sub-supporting member is disposed in such a manner that one end of the sub-supporting member is attached to a central part of a pair of frame sides of the frame over which the aperture grill is stretched and the other end of the sub-supporting member is engaged with a panel pin provided on a panel side wall opposite to the frame side.

4. A color selecting electrode assembly for color cathode ray tubes of claim 3, wherein the sub-supporting member is engaged with the panel pin in a manner to be movable in a tube axis direction to the panel.

5. A color selecting electrode assembly for color cathode ray tubes of claim 1, wherein a sub-supporting member is disposed in such a manner that one end of the sub-supporting member is attached to a central part of a pair of frame sides of the frame over which the aperture grill is stretched and the other end of the sub-supporting member is engaged with a panel pin provided on a panel side wall opposite to the frame side.

6. A color selecting electrode assembly for color cathode ray tubes of claim 5, wherein the sub-supporting member is engaged with the panel pin in a manner to be movable in a tube axis direction to the panel.

* * * * *